US007611401B1

(12) United States Patent
Koren

(10) Patent No.: US 7,611,401 B1
(45) Date of Patent: Nov. 3, 2009

(54) MOUNT FOR A BELT-SANDING APPARATUS

(75) Inventor: Robert Douglas Koren, Cary, NC (US)

(73) Assignee: Column & Post, Inc., Fuquay-Varina, NC (US)

( * ) Notice: Subject to any disclaimer, the term of this patent is extended or adjusted under 35 U.S.C. 154(b) by 470 days.

(21) Appl. No.: 11/239,852

(22) Filed: Sep. 30, 2005

(51) Int. Cl.
*B24B 21/00* (2006.01)

(52) U.S. Cl. ..... 451/310; 451/296

(58) Field of Classification Search ..... 451/49, 451/124, 139, 150, 160, 174, 236, 280, 310
See application file for complete search history.

(56) References Cited

U.S. PATENT DOCUMENTS

| | | | | | |
|---|---|---|---|---|---|
| 1,365,583 | A | * | 1/1921 | Brown | 451/310 |
| 2,401,670 | A | | 6/1946 | Spetz | |
| 3,093,170 | A | | 6/1963 | Thayer | |
| 3,641,709 | A | * | 2/1972 | Gazuit | 451/151 |
| 3,760,537 | A | * | 9/1973 | Bovati | 451/307 |
| 3,800,477 | A | * | 4/1974 | Jendrisak et al. | 451/301 |
| 3,918,209 | A | * | 11/1975 | Crawley et al. | 451/72 |
| 4,055,918 | A | * | 11/1977 | Bralander et al. | 451/139 |
| 4,509,296 | A | | 4/1985 | Rasmussen | |
| 4,648,301 | A | * | 3/1987 | Scott | 83/464 |
| 4,742,649 | A | * | 5/1988 | Fuchs | 451/297 |
| 5,031,365 | A | | 7/1991 | Arndt et al. | |
| 5,772,496 | A | | 6/1998 | Kurtz et al. | |
| 6,086,295 | A | * | 7/2000 | Novak et al. | 409/138 |
| 6,322,432 | B1 | | 11/2001 | Wang | |
| 6,358,115 | B1 | * | 3/2002 | Koike et al. | 451/5 |
| 6,425,811 | B1 | | 7/2002 | Marks, Jr. | |
| 6,641,464 | B1 | | 11/2003 | Steere, III | |
| 7,175,512 | B2 | * | 2/2007 | Huntingdon et al. | 451/234 |
| 7,387,056 | B2 | * | 6/2008 | Higuchi | 83/483 |

* cited by examiner

*Primary Examiner*—Timothy V Eley
(74) *Attorney, Agent, or Firm*—Coats & Bennett, P.L.L.C.

(57) ABSTRACT

A sanding apparatus for finishing an exterior surface of an elongated work piece includes a support structure, a belt-sander, and a mounting bracket to movably mount the belt-sander to the support structure. The bracket is attached to the belt-sander and includes a guide mechanism movably mounted to one or more guide rails of the support structure. The bracket also includes a hinge mechanism that permits the belt-sander to pivot between a first position where an abrasive surface of the belt-sander does not contact the exterior surface of the work piece, and a second position where the abrasive surface contacts the exterior surface of the work piece. In operation, a user moves the belt-sander along the guide rails while the abrasive surface contacts the exterior surface of the work piece to smooth the exterior surface of the work piece.

17 Claims, 4 Drawing Sheets

MOUNT FOR A BELT-SANDING APPARATUS

BACKGROUND

The present invention relates generally to finishing devices, and more particularly to belt-sanders for sanding molded columns and other elongated members.

Columns used in housing construction serve both functional and aesthetic purposes. Functionally, columns are weight-bearing members that support the weight of a structure. Aesthetically, columns give structures an aesthetically pleasing and classical appearance. Most columns used in residential construction are made of wood or wood composites. Wood columns, however, are vulnerable to water damage and rot, and typically require a great deal of maintenance. Molded columns provide an alternative to wood columns. Molded columns also are not vulnerable to water damage or rot, and require much less maintenance than wood columns.

Molded columns are produced using a molding process. The molding process leaves a seam or ridge where the mold separates, which must be removed to provide a smooth outer surface. Typically, the seam line or ridge is removed by manually sanding the column. However, manual sanding of molded columns process is time consuming and labor intensive. The time and labor needed to sand the columns translates into higher costs and lower production.

SUMMARY

The present invention relates to a sanding apparatus and method of smoothing the exterior surface of an elongated work piece, such as a column. The sanding apparatus comprises a support structure, a belt-sander having an abrasive surface on the belt, and a mounting bracket to movably mount the belt-sander to the support structure. In operation, a user moves the belt-sander along the length of the elongated work piece so that the abrasive surface removes unwanted material from the exterior surface of the work piece, such as a residual seam line left over from a molding process, for example.

The support structure comprises a pair of guide rails that suspend the belt-sander above the elongated work piece. One of the guide rails is disposed above the belt-sander, while the other of the guide rails is disposed to the rear of the belt-sander. The belt-sander movably mounts to the guide rails via a mounting bracket. In one embodiment, for example, the mounting bracket comprises a pair of hingedly attached plates. One of the plates fixedly attaches to the belt-sander, while the other of the plates includes a guide mechanism that movably mounts to the guide rails. The guide mechanism may be, for example, guide wheels that roll along the length of the guide rails. Moving the belt-sander along the guide rails allows a user to move the abrasive surface along the length of the elongated work piece.

The mounting bracket plates are hingedly attached with a hinge. The hinge allows the user to pivot the belt-sander between a first position and a second position to bring the abrasive surface of the belt-sander into and out of contact with the work piece. In one embodiment, for example, the user may raise and lower the belt-sander using a handle connected to the belt-sander or to the mounting bracket. In the first position, the abrasive surface of the belt-sander remains away from the work piece, and thus, does not contact the exterior surface of the elongated work piece. In the second position, the abrasive surface is in contact with the exterior surface of the elongated work piece. When the abrasive surface contacts the exterior surface of the work piece, it does so in a direction that is transverse to a longitudinal axis of the work piece.

The belt-sander includes a drive motor, and therefore, is generally a heavy object. Therefore, the mounting bracket may also include one or more counter-balancing members connected to the belt-sander to counter-balance the weight of the belt-sander. This arrangement facilitates the delicate and precise smoothing of the exterior surface of the work piece with the relatively heavy belt-sander by preventing the weight of the belt-sander from resting upon the work piece.

DETAILED DESCRIPTION

The present invention provides a sanding apparatus and method for finishing an elongated work piece to remove unwanted material from the exterior surface of the work piece. By way of example, a user may remove a seam line on an exterior surface of a molded column or post by sanding the seam line with a belt-sander. In the present invention, a belt-sander is movably mounted so that the belt is generally perpendicular to the longitudinal axis of the column and the belt sander moves longitudinally along the length of the column. To remove the seam line along the length of the column, the user simply brings the belt in contact with the surface of the columns and moves the belt-sander longitudinally along the column. Finishing the exterior surface in this manner is generally faster than sanding the seam line manually. In addition, the belt-sander generally conforms to the curvature of the column to prevent damaging the column.

Figure 1:
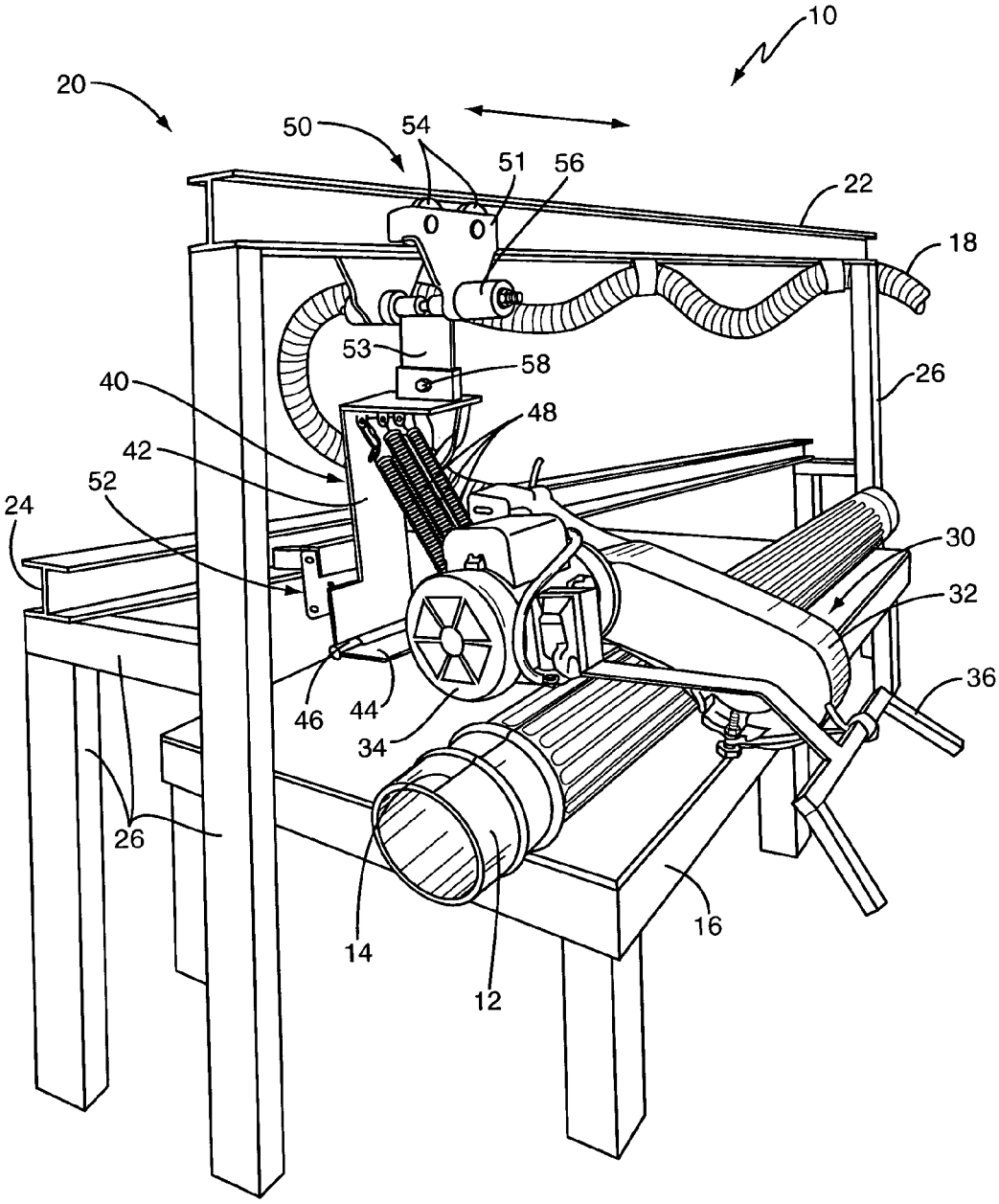
FIG. 1 illustrates a perspective view of one embodiment of the present invention showing the belt-sander movably mounted to the support structure.
Figure 2:
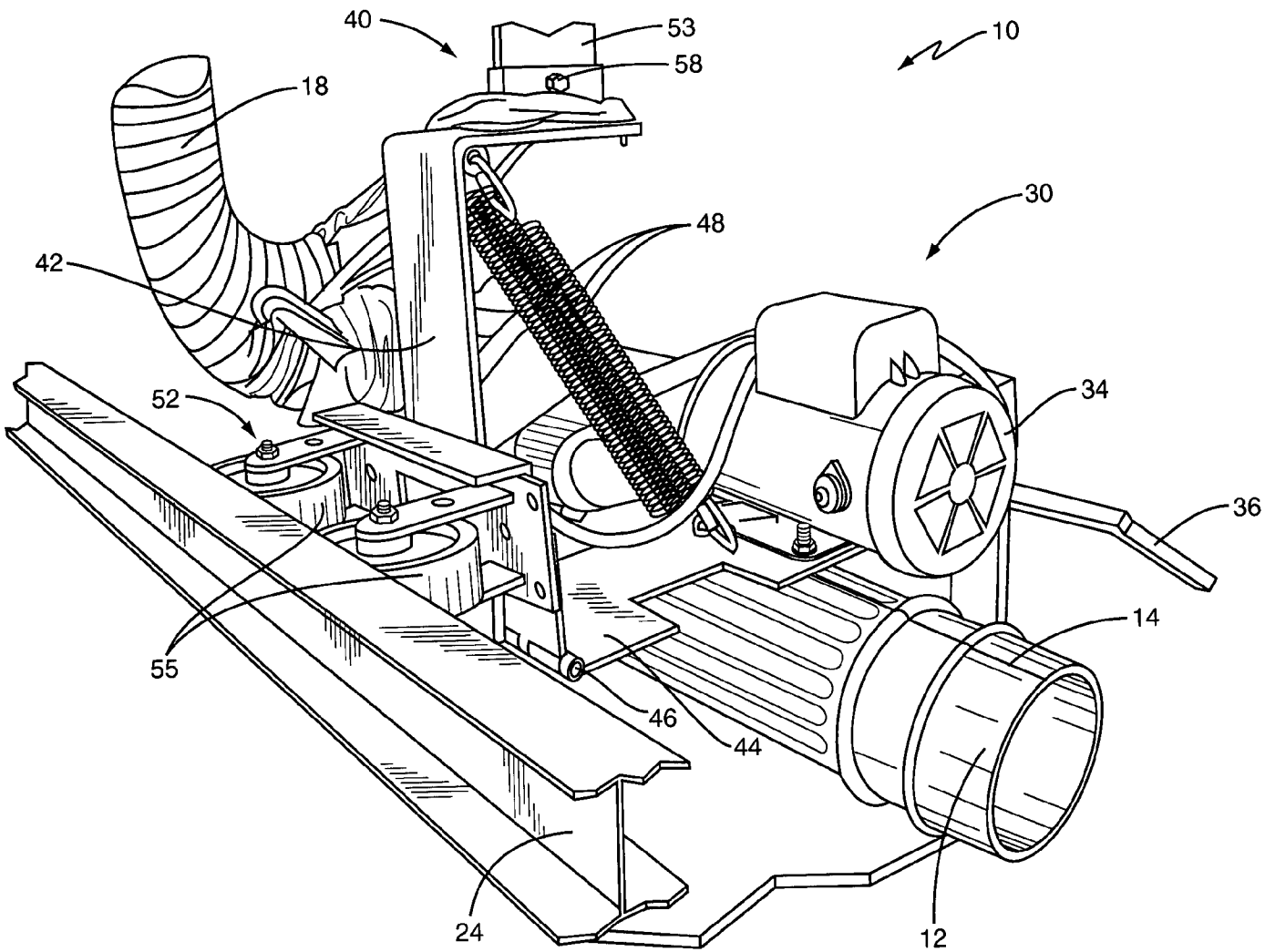
FIG. 2 illustrates a perspective view of one embodiment of the present invention from the rear.

Referring now to FIGS. 1 and 2, a sanding apparatus according to one embodiment of the present invention is shown therein and indicated generally by the number 10. The sanding apparatus 10 comprises a support structure 20, a belt-sander 30, and a mounting bracket 40 that movably mounts the belt-sander 30 to the support structure 20. A worker may employ the sanding apparatus 10 to finish an elongated work piece 12, such as a column. By way of example, the worker may place column 12 on a table 16 or other stable structure, and bring the belt-sander 30 into contact with the exterior surface of the work piece 12. The worker moves the belt-sander 30 longitudinally along the column to remove unwanted matter, such as seam line 14.

The support structure 20 comprises a pair of guide rails 22, 24, which in the embodiment of FIG. 1 are steel I-beams. Guide rails 22 and 24 are disposed such that their longitudinal axes are substantially parallel to one another and to the workpiece. In FIG. 1, for example, a first guide rail 22 is disposed above the belt-sander 30, while a second guide rail 24 is disposed to the rear of belt-sander 30.

Support structure 20 includes a support frame comprising one or more vertical or horizontal members 26 to support the guide rails 22, 24. Alternatively, guide rails 22, 24 may be secured to a surrounding support structure, such as a ceiling and wall of a building (not shown). Support structure 20 supports the weight of belt-sander 30 away from the work piece 12, and allows a user to move the belt-sander 30 back and forth along a longitudinal axis of work piece 12 to finish the exterior surface of work piece 12.

Belt-sander 30 may comprise any conventional belt-sander known in the art. The belt sander 30 comprises a housing 32, a drive motor 34, and a belt 38 (see FIGS. 3A-3B). Belt 38 is typically formed as a continuous loop, and includes an outwardly facing abrasive surface 39. The abrasive surface 39 may be, for example, sandpaper suitable to remove unwanted matter from a work piece.

Mounting bracket 40 movably mounts the belt sander 30 to the support structure 20 such that the belt 38 extends generally perpendicular to the longitudinal axis of the work piece, and such that the belt sander 30 moves longitudinally along the length of the column. In one embodiment, mounting bracket 40 comprises a pair of support plates 42, 44 pivotally connected with a hinge 46. A first support plate 42 includes guide mechanisms 50, 52, that movably mount the mounting bracket 40 to guide rails 22, 24, respectively. The second support plate 44 fixedly attaches to the belt-sander 30. Hinge 46 pivotally connects the first and second support plates 42, 44. Hinge 46 allows the belt sander 30 to move in a vertical plane between raised and lowered positions. The exemplary embodiment includes a single hinge 46, however, those skilled in the art will readily appreciate that more than one hinge 46 may be used to pivotally connect plates 42, 44.

The weight of the belt sander 30 causes the belt sander 30 to rotate downward about the axis of hinge 46. One or more counterbalance springs 48 are provided to counterbalance the weight of the belt sander 20. One end of each spring 48 is secured to the first support plate 42. The opposite end of each spring 48 is secured to the second support plate 44, or to the belt sander 20. The counterbalance springs 48 oppose the weight of the belt sander 30 so that the user can more easily raise and lower the belt-sander 30, and to keep the weight of the belt-sander 30 from bearing down too hard on the work piece 12.

The first and second guide mechanisms 50 and 52 engage the first and second guide rails 22, and 24 respectively. The guide mechanisms 50, 52 permit the user to move the heavy belt-sander 30 with little effort.

The first guide mechanism 50 suspends the belt sander 30 from guide rail 22. Guide mechanism 50 comprises four guide wheels 54 mounted to a carriage 51. The carriage suspends the belt sander 30 from the guide rail 22. The carriage 51 is connected to the first support plate by a pivot plate 53. The pivot plate 53 is connected at its top end to the carriage by a first pivot member 56, and at its lower end to the first support plate by a second pivot member 58. The additional pivot members 56, 58 provide further freedom of movement. In one embodiment, pivot members 56 and 58 comprise single bolts that connect the guide mechanism 50 to the mounting bracket 40. The pivot members 56, 58 allow the belt-sander 30 to pivot side-to-side and front-to-back with respect to the guide rail 22.

A second guide mechanism 52 helps maintain the belt sander 30 in a generally horizontal orientation. Guide mechanism 52 comprises a pair of guide wheels 55 mounted to the back of the first support plate 42 and in contact with guide rail 24. The weight of the belt sander 30 rotates the belt sander 30 about pivot member 58 so that the guide wheels 55 contact the guide rail 24. The guide wheels 55 roll along the guide rail 24 as the user moves the belt-sander 30 back and forth along the work piece 12.

In operation, the user raises and lowers the belt-sander 30 using a handle 36 fixedly attached to belt-sander 30 or mounting bracket 40. The column or other work piece is placed in a holder. The belt sander 30 is then lifted, moved into position above the work piece, and then lowered to bring the belt 38 into contact with the work piece. The tension of the counterbalance springs 48 prevents the belt sander 30 from bearing too hard on the column or work piece. The belt 38 extends transversely across the column or work piece. The motor 34 drives belt 38 so that the abrasive surface 39 removes unwanted matter (e.g., seam line 14) from the exterior of the work piece 12. The unwanted matter is vacuumed from the work area via discharge hose 18.

Figure 3A:
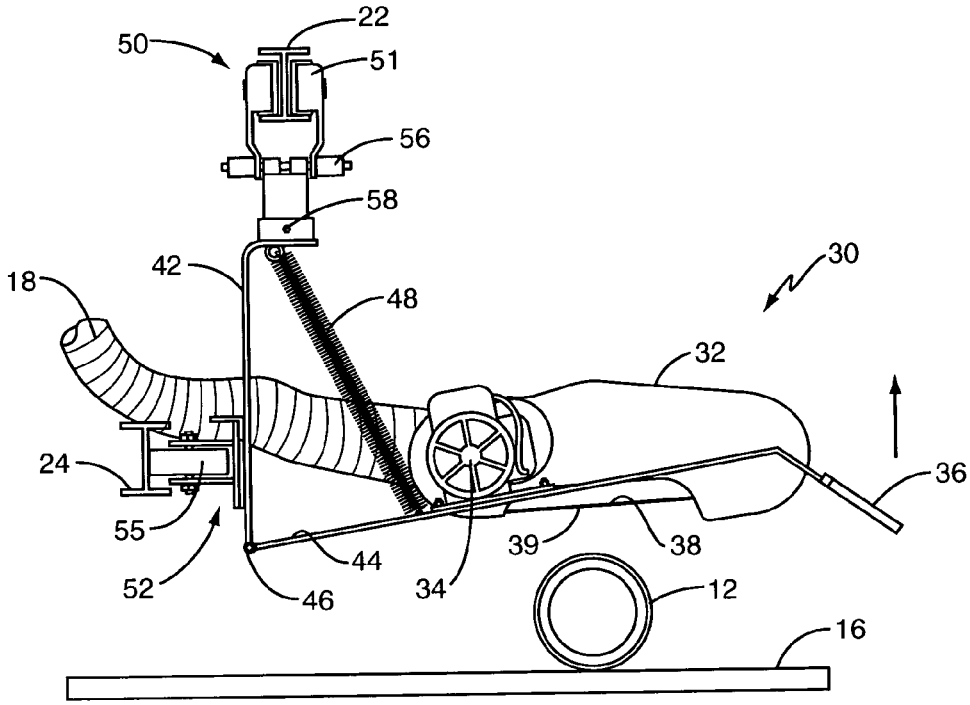
FIGS. 3A and 3B illustrates one embodiment of the present invention wherein the belt-sander pivots between the first and second positions.
Figure 3B:
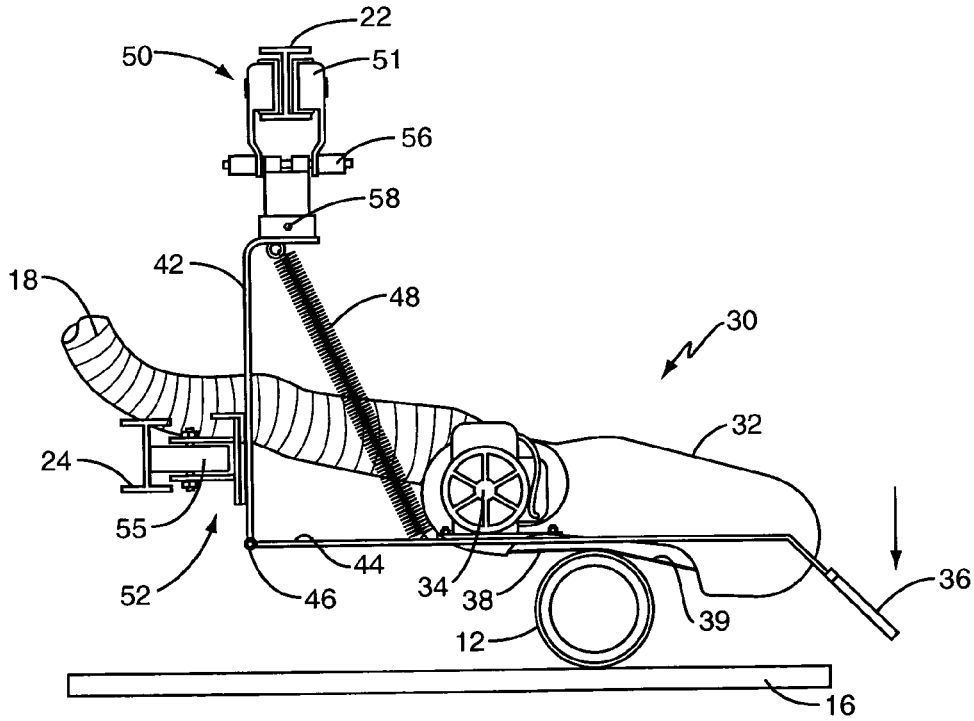

FIGS. 3A-3B illustrate how a user pivots the belt-sander 30 between the raised position (FIG. 3A) and a lowered position (FIG. 3B) about hinge 46. As seen in FIG. 3A, the user has raised the belt-sander 30 to the raised position by lifting the handle 36. This lifts the abrasive surface 39 away from the exterior surface of work piece 12. The counterbalance springs 48 counter the weight of the belt-sander 30, and thus, the user need not strain to lift the belt-sander 30 to the raised position, or maintain the belt-sander in the raised position. In FIG. 3B, the user has lowered the belt sander 30 to bring the belt 38 into contact with the work piece 12. As shown in FIG. 3B, the belt 38 "wraps around" and conforms to the outer surface of the work piece 12. This "wrapping" permits the belt 38 to smooth the exterior surface of the work piece 12 without altering the curvature of work piece 12. In this position, the belt sander 30 is moved along the length of the work piece 12 to sand or finish the surface of the work piece. During the sanding or finishing process, the belt 38 travels in a direction that is generally transverse to the longitudinal axis of the work piece 12, while the entire belt sander moves longitudinally. The counterbalance springs 48 continue to counter the weight of the belt-sander 30. This arrangement permits the user to move the relatively heavy belt-sander 30 along the longitudinal axis of the work piece 12 without undue strain.

The counterbalance springs 48 and the ability of the belt 38 to conform to the curvature of the column facilitate the ability of the belt-sander 30 to follow the curvature of the work piece 12 during the sanding or finishing process. The curvature of columns is typically not uniform along the length. That is, the diameter of the work piece 12 will change slightly over the length of the work piece 12. Columns are typically designed to have a slight outward curvature near the center of the column, called entasis. This outward bulge provides an appearance of substantially parallel sides. The ability of the belt 38 to conform to the changing curvature of the column and the counterbalancing of the springs ensures that the belt 38 will produce a smooth finish without gouging or marring the surface.

Figure 4:
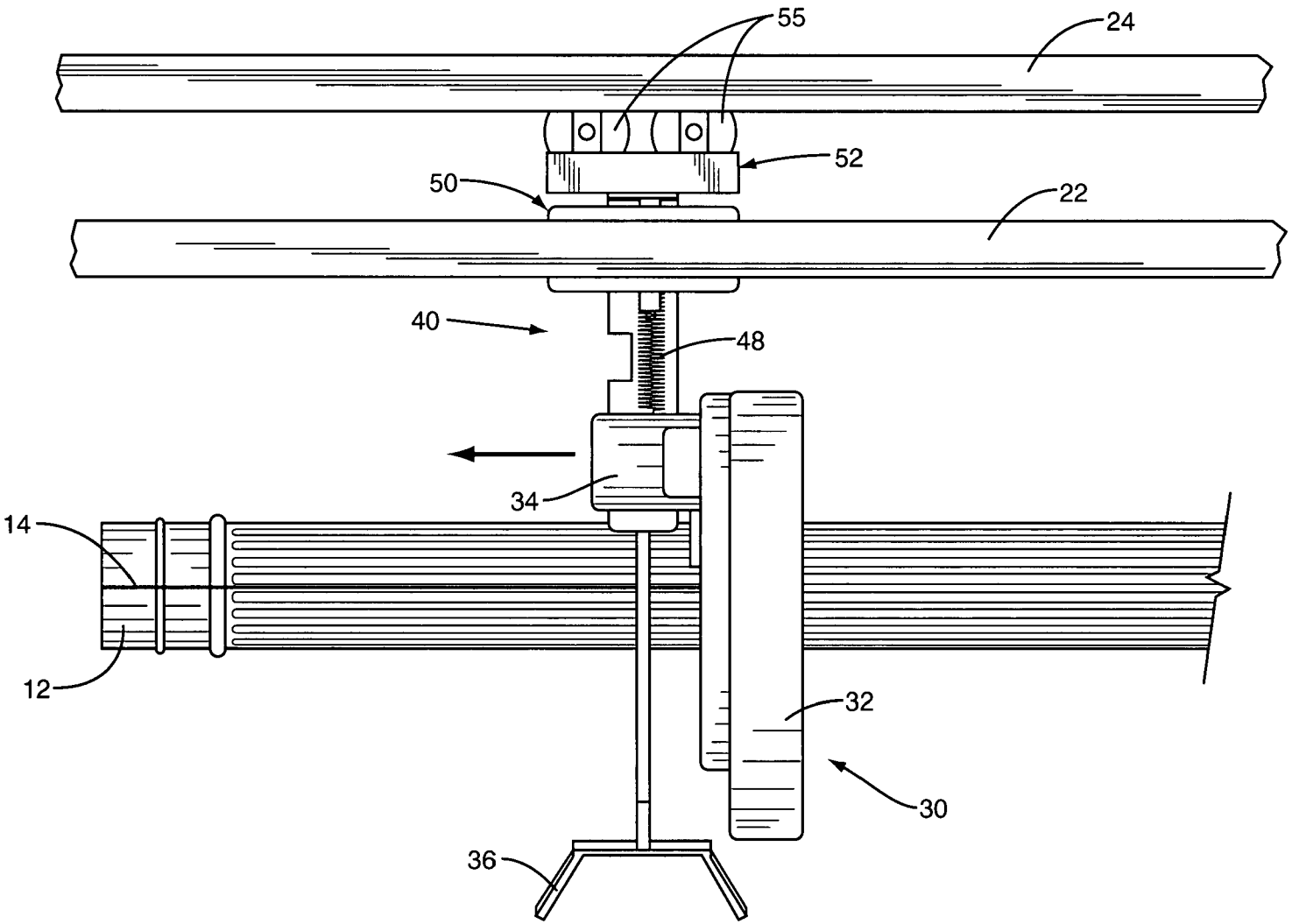
FIG. 4 illustrates a perspective view of one embodiment of the present invention from the top.

FIG. 4 illustrates the sanding apparatus 10 as viewed from the top. The belt sander 30 is in the middle of a sanding or finishing operation moving along the work piece 12 in the direction indicated by the arrow. As the user moves the belt-sander 30, the belt 38 removes the seam line 14 from the work piece 12. Once the user reaches the opposite end of the work piece 12, the user returns the belt-sander 30 to the first position by lifting on the handle 36.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A sanding apparatus for finishing an exterior surface of an elongated work piece comprising:

a belt-sander having an abrasive surface to contact an exterior surface of an elongated work piece;

a support structure comprising:

a first guide rail positioned above the belt-sander; and a second guide rail positioned behind the belt-sander; and a mounting bracket fixedly mounted to the belt-sander and configured to movably connect the belt-sander to the first and second guide rails such that the belt-sander moves along a longitudinal axis of the elongated work piece, the mounting bracket comprising:

a first guide mechanism having a first guide wheel configured to move along a horizontal surface of the first guide rail;

a second guide mechanism having a second guide wheel configured to move along a vertical surface of the second guide rail; and a hinge configured to allow the belt-sander to pivot between a first position where the abrasive surface is not in contact with the exterior surface of the elongated work piece, and a second position where the abrasive surface contacts the exterior surface of the elongated work piece in a direction transverse to a longitudinal axis of the elongated work piece.

2. The sanding apparatus of claim 1 wherein the belt-sander further comprises a drive motor that moves with the belt-sander along the first and second guide rails, and pivots with the belt-sander between the first and second positions.

3. The sanding apparatus of claim 1 wherein the first guide rail is disposed to support the belt-sander above the elongated work piece, and the second guide rail is disposed adjacent a back end of the belt-sander.

4. The sanding apparatus of claim 1 wherein the first and second guide wheels move along the first and second guide rails, respectively, such that the belt-sander is supported above and moves along the longitudinal axis of the elongated work piece.

5. The sanding apparatus of claim 1 wherein the mounting bracket comprises first and second plates hingedly connected by the hinge, and wherein the first and second guide wheels are attached to the first plate.

6. The sanding apparatus of claim 1 wherein the mounting bracket further comprises a plurality of pivot members that pivotably connect the belt sander to the first guide mechanism that movably mounts the belt-sander to the first guide rail.

7. The sanding apparatus of claim 1 wherein the mounting bracket further comprises one or more counterbalance members connected to the belt-sander to counter the weight of the belt-sander in the first and second positions.

8. The sanding apparatus of claim 1 wherein the belt-sander travels along the first and second guide rails while the abrasive surface is in contact with the exterior surface of the elongated work piece.

9. The sanding apparatus of claim 1 wherein the elongated work piece comprises a column, and wherein the abrasive surface is configured to remove a seam from the exterior surface of the column when the belt-sander is in the second position.

10. A sanding apparatus for finishing an exterior surface of an elongated work piece comprising:

a support structure having first and second guide rails;

a belt-sander having an abrasive surface to contact an exterior surface of an elongated work piece, the belt-sander being pivotable between a first position where the abrasive surface is not in contact with the exterior surface of the elongated work piece, and a second position where the abrasive surface is in contact with the exterior surface of the work piece in a direction transverse to a longitudinal axis of the elongated work piece;

a mounting bracket fixedly mounted to the belt-sander and configured to movably connect the belt-sander to the first and second guide rails such that the belt-sander moves along the first and second guide rails and along the longitudinal axis of the elongated work piece; and the mounting bracket comprising a counterbalance member connected to the belt-sander and configured to counter the weight of the belt-sander in the first and second positions.

11. The sanding apparatus of claim 10 wherein the first and second guide rails are disposed such that the first guide rail has a longitudinal axis that is substantially parallel to a longitudinal axis of the second guide rail.

12. The sanding apparatus of claim 11 wherein the mounting bracket comprises a guide mechanism that movably connects the belt-sander to the first and second guide rails, and wherein the guide mechanism comprises first and second guide wheels that move along the longitudinal axes of the first and second guide rails, respectively, such that the belt-sander is supported above and moves along the longitudinal axis of the elongated work piece.

13. The sanding apparatus of claim 12 wherein the mounting bracket further comprises first and second plates hingedly connected by a hinge, and wherein the first guide wheel interconnects the first plate to the first guide rail to support the belt-sander above the elongated work piece, and the second guide wheel interconnects the second plate with the second guide rail.

14. The sanding apparatus of claim 13 wherein the first and second plates pivot about the hinge to permit the belt-sander to pivot between the first and second positions.

15. The sanding apparatus of claim 13 wherein the mounting bracket further comprises a plurality of pivot members configured to pivotably attach the belt-sander to a guide mechanism that movably connects the belt-sander to the first guide rail.

16. The sanding apparatus of claim 10 wherein the belt-sander further comprises a drive motor that moves with the belt-sander along the first and second guide rails, and pivots with the belt-sander between the first and second positions with the belt-sander.

17. The finishing apparatus of claim 10 wherein the belt-sander travels along the first and second guide rails while the abrasive surface is in contact with the exterior surface of the work piece.

* * * * *

UNITED STATES PATENT AND TRADEMARK OFFICE

CERTIFICATE OF CORRECTION

PATENT NO. : 7,611,401 B1
APPLICATION NO. : 11/239852
DATED : November 3, 2009
INVENTOR(S) : Robert Douglas Koren It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 869 days.

Signed and Sealed this

Twelfth Day of October, 2010

David J. Kappos

David J. Kappos
*Director of the United States Patent and Trademark Office*